United States Patent [19]

McLellan

[11] Patent Number: 4,553,480

[45] Date of Patent: Nov. 19, 1985

[54] NO FLASH, VERY LOW NOISE HOWITZER ROUND AND TUBE

[76] Inventor: Norvel J. McLellan, 1002 N. Main St., Pleasanton, Tex. 78064

[21] Appl. No.: 519,839

[22] Filed: Aug. 3, 1983

Related U.S. Application Data

[63] Continuation-in-part of Ser. No. 356,817, Apr. 29, 1982, abandoned.

[51] Int. Cl.[4] ..... F42B 13/16; F41F 1/00

[52] U.S. Cl. ..... 102/430; 89/7; 89/14.6

[58] Field of Search ..... 89/1 B, 7, 14.2, 14.4, 89/14.6; 102/703, 403; 227/9, 10

[56] References Cited

U.S. PATENT DOCUMENTS

| | | | |
|---|---|---|---|
| 1,314,801 | 9/1919 | Hanzlik | 89/7 |
| 1,359,295 | 11/1920 | Trumble | 89/7 |
| 1,416,828 | 5/1922 | Holmes | 89/14.6 |
| 3,837,107 | 9/1974 | Swaim et al. | 89/14.6 |
| 4,173,186 | 11/1979 | Dunham | 102/430 |
| 4,478,150 | 10/1984 | Sayler et al. | 102/430 |

OTHER PUBLICATIONS

Bradshaw Armendt & George Crews, "Hypervelocity Guns", *The American Rifleman,* Nov. 1962, pp. 17–19.

*Primary Examiner*—Charles T. Jordan
*Assistant Examiner*—Ted L. Parr

[57] ABSTRACT

The device is a very low noise, no muzzle flash howitzer round and matching tube. It comprises a case, a propellant, a projectile, and a plunger which launches the projectile from the case. With a mount and breech it provides a way of firing projectiles so the enemy cannot discern their source. Rockets may also be launched by this device so their own propellants are ignited well away from the launcher. The device is near silent at muzzle velocities below the speed of sound and it has good range.

2 Claims, 1 Drawing Figure

NO FLASH, VERY LOW NOISE HOWITZER ROUND AND TUBE

This application is a continuation-in-part of application Ser. No. 356,817, filed 4/29/82, abandoned.

SUMMARY OF THE INVENTION

The invention is a howitzer round made up of a case, a primer, a propellant, a projectile, a plunger and a washer. The plunger has a rear or head portion and a plug portion and a hole through its center. The projectile has a tail that fits into the hole in the plunger. The washer closes the front of the case and holds the projectile in place. There is also a matching tube that has a chamber and barrel.

The device has two special features that make it different from other howitzers allowing for low noise and no muzzle flash, as well as safety and ease of spent case ejection.

One special feature is the plunger, whose forward motion builds up pressure in the forward part of the round case and prevents sudden escape of burnt gases and prevents solid contact of the forward face of the head of the plunger with the washer that is in the front of the round.

The other special feature is a valve made up of the hole through the plunger and the tail of the projectile that fits into the hole.

The invention is a very quiet, no muzzle flash way to shoot a projectile. When it is mounted on a suitable mount and breech it can shoot large projectiles with little noise if their muzzle velocity is kept below the speed of sound.

BRIEF DESCRIPTION OF THE DRAWING

The drawing shows a cross sectional view of one embodiment of the howitzer round and tube.

DESCRIPTION OF THE PREFERRED EMBODIMENT

Figure 1:
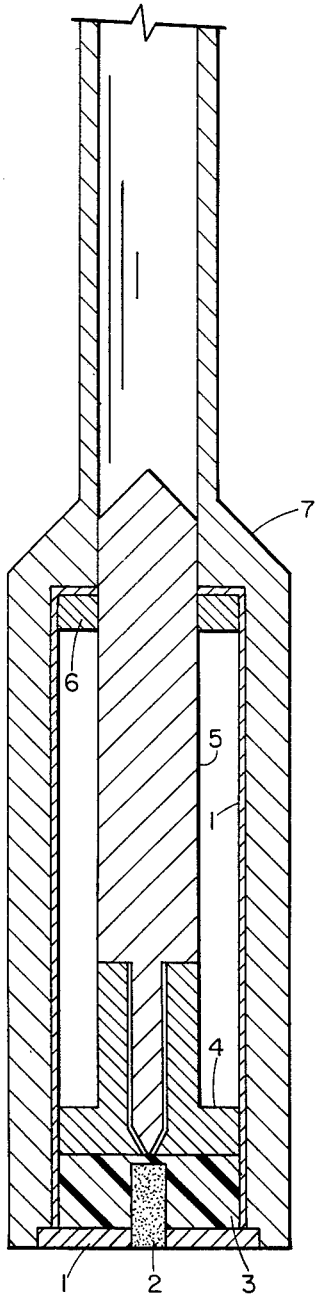

Referring to the drawing, a howitzer round and matching tube is shown comprising generally cylindrical case 1, primer 2, propellant 3, and plunger 4. The plunger has a rear or head portion and a plug portion. There is a longitudinal hole through the center of the plunger into which a tail portion of projectile 5 fits, thereby forming a pressure release valve. The rear part of the hole is made the desired size to control the rate of escape of the burned gases of propellant 3 thereby allowing control over the noise of the gases as they are released. The release of said gases from case 1 before the case is ejected makes possible the use of a thinner case than would otherwise be possible.

Washer 6 holds the front end of projectile 5 in place within tube 7 which forms a barrel for the projectile. There is an air tight air space that is defined by the forward part of case 1, plunger 4, projectile 5, and washer 6. Washer 6 is parallel to the front face of the head portion of the plunger. This is important to keep the head portion from striking washer 6.

Primer 2 is made long enough that it ignites propellant 3 at its front end. The advantages are that the propellant is not pushed forward as it burns, resulting in more even burning, and consequently, less muzzle flash. This opens the way for the use of new propellants and less muzzle flash in other guns as well.

The plug portion of plunger 4 has the functions of defining the air tight air space, forming part of the pressure release valve, acting as a conduit to conduct burned propellant gases to tube 7, and holding the tail portion of projectile 5 in place.

In an alternative embodiment (not shown) the plug portion of plunger 4 may be made long enough to plug the hole in washer 6 before the round is fired. In this embodiment the washer would hold the front end of the plug instead of the projectile.

In operation, with the invention placed in a suitable gun tube and the breech closed, when the trigger is pulled, primer 2 fires, propellant 3 burns, and plunger 4 is pushed forward imparting kinetic energy to projectile 5. The air in the forward part of case 1 is compressed by forward movement of the plunger. As pressure is built up the plunger slows and stops before the forward face of the head portion strikes washer 6. When the plunger starts slowing the tail of projectile 5 moves out of the hole in the plunger. This opens the hole in plunger 4 and lets the gases of burned propellant 3 escape slowly through tube 7. When the pressure from burned propellant 3 is reduced to below the pressure in the front part of case 1, plunger 4 moves back and relieves the pressure in the front part of case 1. With the pressure released from the case it is safe to open the breech and eject the case.

As plunger 4 moves forward when the round is fired the plug portion plugs the hole in washer 6 before the plunger and projectile separate. The movement of the plunger is affected by any leakage that develops in the air tight air space when the round is fired.

I claim:

1. A howitzer round and matching tube comprising a generally cylindrical case, a primer situated at the rear of said case, a propellant contained within said case adjacent the primer, a projectile, and a tube connected to the front of said case which forms a barrel of the same diameter as said projectile, wherein the improvement comprises:

said case containing a plunger, said plunger having a rear portion adjacent the propellant of essentially the same diameter as the interior of said case and a plug portion of a smaller diameter extending forwardly from said rear portion, said plunger having a longitudinal hole through the rear and plug portions;

said projectile being the diameter of said plug portion of the plunger and having a tail portion which fills said longitudinal hole in the plunger, said projectile extending into said tube when at rest, thereby forming an enclosed annular space between the projectile and the case;

said case also containing a washer adjacent the tube which is in air tight engagement with said case and said projectile.

2. The howitzer round and matching tube of claim 1 wherein the primer is elongated and initiates the propellant near the front of the propellant so that the propellant burns from front to rear.

* * * * *